United States Patent [19]

Petersen

[11] 4,288,964

[45] Sep. 15, 1981

[54] METHOD FOR THE INSULATION OF ROOFS

[75] Inventor: Jorgen S. Petersen, Roskilde, Denmark

[73] Assignee: Rockwool International A/S, Hedehusene, Denmark

[21] Appl. No.: 21,758

[22] Filed: Mar. 19, 1979

[30] Foreign Application Priority Data

Mar. 12, 1978 [DK] Denmark ..... 1261/78
Jun. 15, 1978 [DK] Denmark ..... 2693/78

[51] Int. Cl.[3] ..... E04B 5/00
[52] U.S. Cl. ..... 52/747; 52/408
[58] Field of Search ..... 52/408, 741, 747, 411, 52/309.1, 412, 309.13

[56] References Cited

U.S. PATENT DOCUMENTS 3,012,923 12/1961 Slayter ..... 156/62.2
3,411,256 11/1968 Best ..... 52/408
3,488,247 1/1970 Bushnell, Jr. et al. ..... 52/309.1 X

FOREIGN PATENT DOCUMENTS 2736992 3/1979 Fed. Rep. of Germany ..... 52/408

*Primary Examiner*—Carl D. Friedman
*Attorney, Agent, or Firm*—Lawrence Rosen

[57] ABSTRACT

Method for insulating of roofs by which insulating slabs of mineral wool with fibres bonded at their intersections are placed on top of the water-impermeable membrane on the roof. The insulating slabs on their surface facing the water-impermeable membrane are provided with a vapor-impermeable foil.

5 Claims, 3 Drawing Figures

METHOD FOR THE INSULATION OF ROOFS

Figure 1:
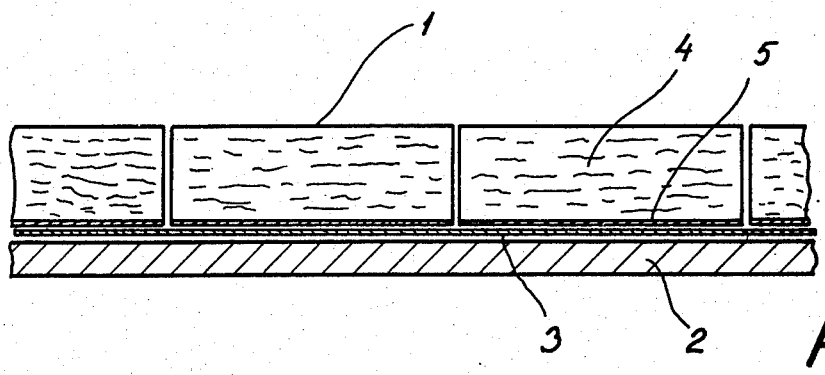

The present invention relates to a method for insulating roofs by which the insulating material is placed on top of the water-impermeable membrane in form of slabs, which possibly are fastened to the roof by gluing or by the addition of a weight on top of the slabs.

In the insulation of flat roofs after the water-impermeable membrane has been established it is known to place on the membrane slabs of foamed plastics with closed cells or a foam material of glass. In order to protect the foamed plastics or the glassfoam from the influence of the weather it is necessary on top of the slabs to place a weatherproof protective layer, for example pebbles. With this method of insulation a considerable extra load is added to the original weight of the roof, the extra load mostly coming from the pebbles. Often the roofs have not been designed to carry such an extra load, and if the roof is constructed to carry the load of the stones, the load carrying construction will be more expensive and more material consuming than necessary to carry the load from snow and traffic on the roof.

Another method for insulating flat roofs consists in on top of the waterproof layer of for example roofing felt to place slabs of mineral wool and to cover these with a new water-impermeable membrane. This method of insulating is comparatively expensive because it implies establishing of another water-impermeable layer.

It has been tried to place mineral wool slabs on top of the waterproof membrane of a roof and it has been found, that the mineral wool as such is weatherproof and therefore well suited for the purpose, but the insulation property is reduced by 25–30% compared by mineral wool of a corresponding thickness but placed between two waterproof layers.

The purpose of the present invention is to provide a method for insulation of roofs of the kind mentioned above but in which the said reduction in the insulating property is not present.

According to the invention this is obtained by a method which is characterized in that the slabs consist of fibres which are mutually bonded by means of a resin and in that the slabs on the surface facing the waterproof membrane of the roof are lined with a vapour-impermeable foil.

Surprisingly it has been found that the vapour-impermeable foil is able to prevent the reduction in the insulating property to take place. The reason for this may be, that the evaporation of the water, which inevitably penetrates between the insulating slabs and the water-impermeable membrane of the roof is prevented from evaporating and diffusing through the mineral wool. The foil further forms an excellent basis for a fastening of the insulating slabs, for example by partial gluing and prevents adverse consequences of a defective gluing.

It has been found that on flat roofs water will often remain for long periods in the joints between the slabs. The remaining water in the long run produces a disintegration of the mineral fibres on the side faces of the mineral wool slabs, whereby a thin layer in the joints will be water absorbing. The water absorbing layer is able to transport water to the upper surface of the mineral wool slabs, where its evaporation removes heat from the roof, which is to be insulated. The total insulating property of the insulating layer thereby is reduced and the advantage of adding the vapour-impermeable foil to the insulating layer is reduced.

A further object of the present invention is to eliminate these disadvantages. According to the invention this is obtained by extending the vapour-impermeable foil to at least partly to cover the side faces of the mineral wool slabs.

By in this way preventing the water between the slabs to penetrate into the slabs, the disintegration of the mineral wool, which in the long run makes the edges of the mineral slabs water absorbing, is avoided. It is not necessary and under some circumstances less favourable that the extension of the foil continues to the top surface of the mineral wool slab as it provides a possibility for water to remain for long periods on top of the slabs as the upstanding edges of the extensions may prevent the water from running away.

The extensions of the vapour-impermeable foil may according to the invention consist of an asphalt layer applied to the side faces, and this asphalt layer may possibly form part of the adhesive for the insulating slabs to water-impermeable membrane of the roof.

Figure 2:
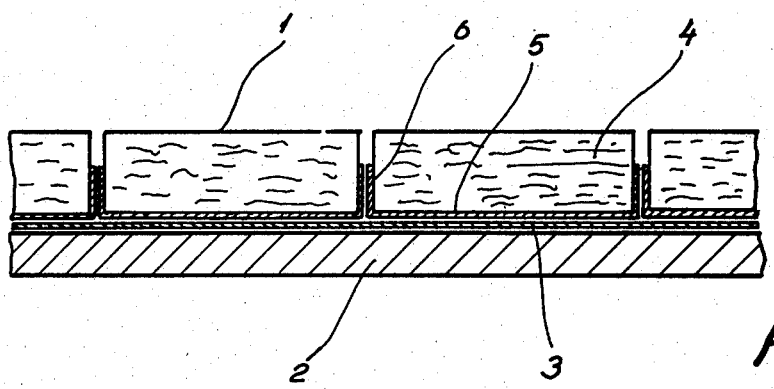
Figure 3:
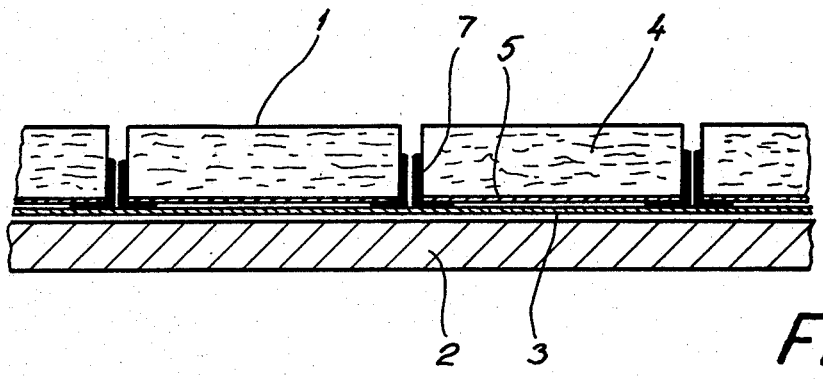

The invention is described in the following with reference to the drawing in which FIG. 1 shows a vertical section through a roof insulated in accordance with the method according to the invention, FIG. 2 shows a second embodiment according to the invention with a folded-up vapour-impermeable foil, and FIG. 3 shows a third embodiment according to the invention in which the extension of the vapour-impermeable foil is established by means of an asphalt layer.

In the drawing the illustrated roof 1 comprises a load carrying layer 2, which may be a layer of wooden boards on rafters. The load carrying layer also may be a concrete covering or a suitable construction, which is suited for supporting a water-impermeable membrane 3. This membrane 3 may consist of one or more layers of roofing felt, but may also consist of a plastic or metal foil.

By the method for insulating the roof, slabs 4 of mineral wool are placed on top of the water-impermeable membrane, the mineral wool being of a type in which the fibres are mutually bonded at their intersections by means of a bonding agent. The bonding agent, which for example may be a phenol-formaldehyde resin, gives the mineral wool sufficient strength to withstand the influence of weather and further prevents that water is absorbed into the mineral wool. The mineral wool may also be bonded by other resins which are able to provide the mineral wool with sufficient form stability and water repellant properties. The mineral wool is selected with a density giving sufficient strength to withstand influences from for example persons who walk on the roof or from objects hitting the roof.

According to the method, the mineral wool slabs 4 are provided with a vapour-impermeable foil 5 on the surface facing the water-impermeable membrane 3. This foil 5 prevents an evaporation of the moisture, which from time to time penetrates between the foil 5 and the water-impermeable membrane 3. The slabs may be fastened by partial gluing to the membrane 3 or be fastened in other ways. Under certain circumstances a fastening is unnecessary as the slabs 4 by their weight alone will be sufficiently secured.

Further according to the method the foil 6 may be extended along the side faces of the slabs as shown in FIG. 2. The extension does not necessarily continue to the upper surface of the slabs 4, but may stop, for example just above the middle. Thereby it is prevented that the extensions 6, as the slabs as the years pass are weathered on the top surface, stand up as free edges which may further the weathering by preventing drainage. The extension of the foil 5 prevents water present between or under the slabs from eroding the edges of the slabs, by which erosion the slabs would become slightly water absorbing, which would reduce their insulating property.

The extension of the foil also can be provided as an asphalt layer 7 (FIG. 3), which is applied on the lower portion of the side faces and on a portion of the underside of the foil 5. The asphalt layer further may be used to provide a partial bonding of the mineral wool slabs to the water-impermeable membrane of the roof.

What is claimed is:

1. In a method for insulating roofs having a water-impermeable membrane on the exposed surface thereof whereby insulating material, in the form of slabs, is placed on top of the water-impermeable membrane; the improvement which comprises utilizing insulating slabs consisting of mineral wool with fibres which are mutually bonded at their intersections by means of a resin and wherein the surfaces of the slabs facing the water-impermeable membrane are provided with a vapour-impermeable foil.

2. Method according to claim 1, characterized in that the slabs are fastened to the roof by gluing.

3. Method according to claim 1, characterized in that the slabs are fastened to the roof by the addition of a weight on top of the slabs.

4. Method according to claim 1, characterized in that the vapour-impermeable foil is extended to at least partially to cover the side faces of the mineral wool slabs.

5. Method according to claim 4, characterized in that the extension consists of an asphalt layer applied to the side faces, which asphalt layer may form part of the bonding or the insulating slabs to the water-impermeable membrane of the roof.

* * * * *